US007839094B2

(12) United States Patent
Nerone

(10) Patent No.: US 7,839,094 B2
(45) Date of Patent: Nov. 23, 2010

(54) VOLTAGE FED PROGRAMMED START BALLAST

(75) Inventor: Louis R. Nerone, Brecksville, OH (US)

(73) Assignee: General Electric Company, Schenectady, NY (US)

( * ) Notice: Subject to any disclaimer, the term of this patent is extended or adjusted under 35 U.S.C. 154(b) by 358 days.

(21) Appl. No.: 12/114,332

(22) Filed: May 2, 2008

(65) Prior Publication Data

US 2009/0273283 A1 Nov. 5, 2009

(51) Int. Cl.
*H05B 37/02* (2006.01)

(52) U.S. Cl. ..... 315/224; 315/278; 315/309; 315/324

(58) Field of Classification Search ..... 315/209 R, 315/210, 224–226, 209 M, 209 CD, 227 R, 315/244, 250, 254, 276, 278, 283, 291, 307, 315/309, 312, 324
See application file for complete search history.

(56) References Cited

U.S. PATENT DOCUMENTS

| | | | | |
|---|---|---|---|---|
| 4,525,649 | A | 6/1985 | Knoll et al. | |
| 4,641,061 | A * | 2/1987 | Munson | 315/210 |
| 6,111,369 | A * | 8/2000 | Pinchuk et al. | 315/307 |
| 6,232,726 | B1 * | 5/2001 | Janczak | 315/224 |
| 6,433,490 | B2 * | 8/2002 | Koch et al. | 315/224 |
| 6,815,908 | B2 * | 11/2004 | Glaser et al. | 315/224 |
| 6,867,553 | B2 * | 3/2005 | Nerone et al. | 315/224 |
| 6,936,970 | B2 * | 8/2005 | Chen et al. | 315/105 |
| 7,176,639 | B2 * | 2/2007 | Hu et al. | 315/307 |
| 7,239,091 | B2 * | 7/2007 | Shinmen et al. | 315/224 |
| 2007/0176564 | A1 | 8/2007 | Nerone et al. | |

FOREIGN PATENT DOCUMENTS

| | | |
|---|---|---|
| EP | 0 926 928 A1 | 6/1999 |
| EP | 1 089 600 A1 | 4/2001 |
| JP | 2007-165127 | 6/2007 |
| WO | WO 2007/067718 A1 | 6/2007 |
| WO | WO 2008/029655 | 3/2008 |

OTHER PUBLICATIONS

PCT/US2009/039711 International Search Report, mailed Jul. 14, 2009.

* cited by examiner

*Primary Examiner*—Thuy Vinh Tran
(74) *Attorney, Agent, or Firm*—Fay Sharpe LLP

(57) ABSTRACT

A lighting ballast (10) includes an inverter portion (12) and a resonant portion (14). During a preheat phase, a filament transformer (110) supplies preheat glow currents to lamp cathodes. Also during the preheat phase, the filament transformer boosts the oscillation frequency of the inverter portion (12) to a frequency above a resonant frequency of the resonant portion (14). Once the lamp cathodes are sufficiently heated, the filament transformer (110) is removed from the circuit and the inverter (12) is allowed to start oscillating. A feedback network (150) monitors a high frequency bus (26) and provides input to a shunt regulator (170). The shunt regulator drives the gate of a switch (128) of a bias network (126) and adds or removes the filament transformer (110) to the circuit depending on the conductive state of the switch (128).

21 Claims, 2 Drawing Sheets

VOLTAGE FED PROGRAMMED START BALLAST

This application relates to currently pending U.S. application Ser. No. 11/343,335 to Nerone, et al., which is hereby incorporated by reference in its entirety.

BACKGROUND

The present application relates to electronic lighting. More specifically, it relates to producing a low glow current to pre-heat lamp cathodes in a voltage fed electronic ballast. It is to be understood, however, that the present application can be applied to other lighting applications and ballasts, and is not limited to the aforementioned application.

Typical programmed start ballasts provide a low-glow preheating current to an attached lamp when the ballast is activated. This preheating extends the life of the lamp because it helps to avoid damage to the cathodes of the lamp that would accompany firing the lamp with cold cathodes. Typically, before striking the lamp, a ballast would enter a preheat mode controlled by an integrated circuit (IC), usually a high voltage IC. This IC could drive the inverter above and below resonance, and resultantly, it would require capacitive mode detection to avoid damage to the MOSFET switches of the inverter. If the intrinsic diodes of the MOSFETs turns conductive before gate turnoff, the MOSFET could be damaged or destroyed. Capacitive mode detection helps to prevent this.

As an alternative to an IC controller, a self-oscillating mode with inverter clamping has been used. This alternative tends to shorten lamp life because the pre-heat glow current is too high. Presently there is no reliable way to provide a low current preheat signal in a non-capacitive mode.

The present application contemplates a new and improved voltage fed electronic ballast that overcomes the above-referenced problems and others.

BRIEF DESCRIPTION

In accordance with one aspect, a lamp ballast is provided. An inverter portion receives a direct current input from a DC bus and converts it into an alternating current output. A resonant portion receives the alternating current from the inverter portion and supplies it to a plurality of lamps. A filament transformer provides a preheat current to cathodes of the lamps during a preheat phase.

In accordance with another aspect, a method of igniting at least one lamp is provided. A signal of a DC bus is ramped up to an operating voltage. The DC bus signal is provided to an inverter which converts the DC bus signal into an AC signal. The AC signal is provided to a resonant portion having a characteristic resonant frequency. A preheat current is provided to cathodes of the at least one lamp with a filament transformer. A frequency of the AC signal is boosted to a frequency greater than the characteristic resonant frequency of the resonant portion, preventing the AC signal from lighting the at least one lamp. The frequency of the AC signal is lowered to the characteristic resonant frequency, igniting the at least one lamp. the preheat current is removed from the cathodes of the at least one lamp.

In accordance with another aspect, an improvement to an instant start lighting ballast is provided. A filament transformer includes a primary winding and a first set of secondary windings and a second set of secondary windings, the first set of secondary windings providing preheat currents to cathodes of lamps, and the second set of secondary windings providing additional drive signals to gate drive circuitry of first and second transistors.

DETAILED DESCRIPTION

Figure 1:
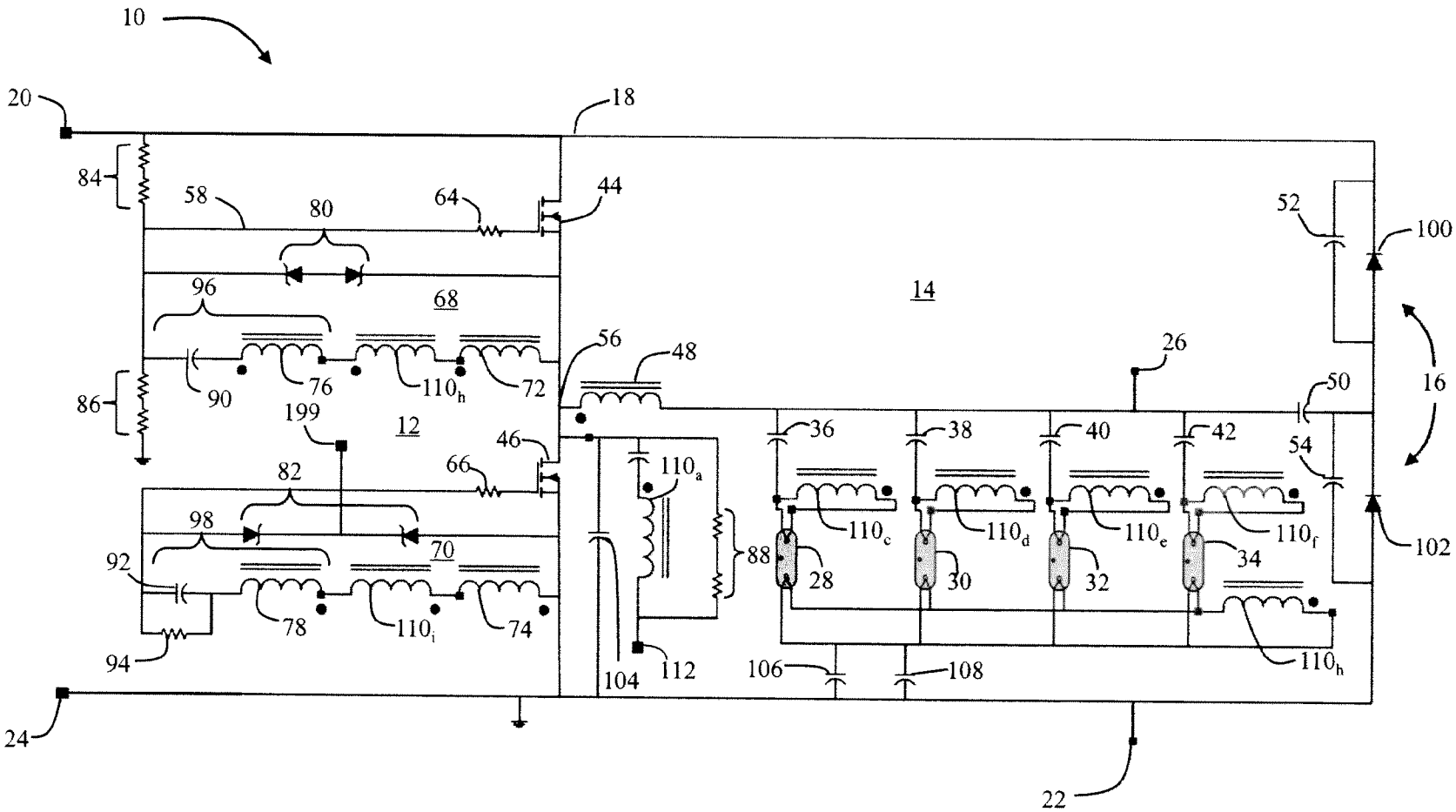
FIG. 1 is a circuit diagram depicting a voltage fed ballast, in accordance with the present application.

With reference to FIG. 1, a ballast circuit 10 includes an inverter circuit 12, resonant circuit or network 14, and a clamping circuit 16. A DC voltage is supplied to the inverter 12 via a positive bus rail 18 running from a positive voltage terminal 20. The circuit 10 completes at a common conductor 22 connected to a ground or common terminal 24. A high frequency bus 26 is generated by the resonant circuit 14 as described in more detail below. First, second, third, through $n^{th}$ lamps 28, 30, 32, 34 are coupled to the high frequency bus 26 via first, second, third, and $n^{th}$ ballasting capacitors 36, 38, 40, 42. Thus, if one lamp is removed, the others continue to operate. It is contemplated that any number of lamps can be connected to the high frequency bus 26, for example, four lamps are depicted in the illustrated embodiment.

The inverter 12 includes analogous upper and lower, that is, first and second switches 44 and 46, for example, two n-channel MOSFET devices (as shown), serially connected between conductors 18 and 22, to excite the resonant circuit 14. It is to be understood that other types of transistors, such as p-channel MOSFETs, other field effect transistors, or bipolar junction transistors may also be so configured. The high frequency bus 26 is generated by the inverter 12 and the resonant circuit 14 and includes a resonant inductor 48 and an equivalent resonant capacitance that includes the equivalence of first, second, and third capacitors 50, 52, 54 and ballasting capacitors 36, 38, 40, 42 which also prevent DC current from flowing through the lamps 28, 30, 32, 34. Although they do contribute to the resonant circuit, the ballasting capacitors 36, 38, 40, 42 are primarily used as ballasting capacitors. The switches 44 and 46 cooperate to provide a square wave at a common first node 56 to excite the resonant circuit 14. Gate or control lines 58, 60, running from the switches 44 and 46 are connected at a control or second node 62. Each control line 58, 60 includes a respective resistance 64, 66.

First and second gate drive circuits, generally designated 68 and 70, respectively, include first and second driving inductors 72, 74 that are secondary windings mutually coupled to the resonant inductor 48 to induce a voltage in the driving inductors 72, 74 proportional to the instantaneous rate of change of current in the resonant circuit 14. First and second secondary inductors 76, 78 are serially connected to the first and second driving inductors 72, 74 and the gate control lines 58 and 60. The gate drive circuits 68, 70 are used to control the operation of the respective upper and lower switches 44, 46. More particularly, the gate drive circuits 68, 70 maintain the upper switch 44 "on" for a first half cycle and the lower switch 46 "on" for a second half cycle. The square wave is generated at the node 56 and is used to excite the resonant circuit. First and second bi-directional voltage clamps 80, 82 are connected in parallel to the secondary inductors 76, 78, respectively, each including a pair of oppositely oriented Zener diodes. The bi-directional voltage clamps 80, 82 act to clamp positive and negative excursions of gate-to-source voltage to respective limits determined by the voltage ratings of the oppositely oriented Zener diodes. Each bi-directional voltage clamp 80, 82 cooperates with the respective first or second secondary inductor 76, 78 so that the phase angle between the fundamental frequency component of voltage across the resonant circuit 14 and the AC current in the resonant inductor 48 approaches zero during ignition of the lamps. The described relationship allows the inverter 12 to operate in a self-oscillating mode that does not require an external IC to drive the inverter 12.

Serially connected resistors 84, 86, cooperate with a resistor 88 connected between the common node 56 and node 112, for starting regenerative operation of the gate drive circuits 68, 70. Upper and lower capacitors 90, 92 are connected in series with the respective first and second secondary inductors 76, 78. In the starting process, the capacitor 90 is charged from the voltage terminal 20 via the resistors 84, 86, 88. A resistor 94 shunts the capacitor 92 to prevent the capacitor 92 from charging. This prevents the switches 44 and 46 from turning on initially at the same time. The voltage across the capacitor 90 is initially zero, and during the starting process, the serially connected inductors 72 and 76 act essentially as a short circuit, due to a relatively long time constant for charging of the capacitor 90. When the capacitor 90 is charged to the threshold voltage of the gate-to-source voltage of the switch 44, e.g., 2-3 Volts the switch 44 turns on, which results in a small bias current flowing through the switch 44. The resulting current biases the switch 44 in a common drain, Class A amplifier configuration. This produces and amplifier of sufficient gain such that the combination of the resonant circuit 14 and the gate control circuit 68 produces a regenerative action which starts the inverter 12 into oscillation, near the resonant frequency of the network including the capacitor 90 and inductor 76. The generated frequency is above the resonant frequency of the resonant circuit 14, which allows the inverter 12 to operate above the resonant frequency of the resonant network 14. This produces a resonant current that lags the fundamental of the voltage produced at the common node 56, allowing the inverter 12 to operate in the soft-switching mode prior to igniting the lamps. Thus, the inverter 12 starts operating in the linear mode and transitions to the switching Class D mode. Then, as the current builds up through the resonant circuit 14, the Voltage of the high frequency bus 22 increases to ignite the lamps, while maintaining the soft-switching mode, through ignition and into the conducting, arc mode of the lamps.

Upper and lower capacitors 90, 92 are connected in series with the respective first and second secondary inductors 76, 78. In the starting process, the capacitor 90 is charged from the voltage terminal 18. The voltage across the capacitor 90 is initially zero, and during the starting process, the serially connected inductors 72 and 76 act essentially as a short circuit, due to the relatively long time constant for charging the capacitor 90. When the capacitor 90 is charged to the threshold voltage of the gate-to-source voltage of the switch 44 (e.g. 2-3 Volts), the switch 44 turns on, which results in a small bias current flowing through the switch 44. The resulting current biases the switch 44 in a common drain, Class A amplifier configuration. This produces an amplifier of sufficient gain such that the combination of the resonant circuit 14 and the gate control circuit 68 produces a regenerative, that is, self-oscillating action that starts the inverter into oscillation, near the resonant frequency of the network including the capacitor 90 and the inductor 76. Self-oscillation occurs due to the use of regenerative feedback path that drives the gates of the switches 44, 46. The generated frequency is above the resonant frequency of the resonant circuit 14. This produces a resonant current that lags the fundamental of the voltage produced at the common node 56, allowing the inverter 12 to operate in the soft-switching mode prior to igniting the lamps. Thus, the inverter 12 starts operating in the linear mode and transitions into the switching Class D mode. Then, as the current builds up through the resonant circuit 14, the voltage of the high frequency bus 26 increases to ignite the lamps, while maintaining the soft-switching mode, through ignition and into the conducting, arc mode of the lamps.

During steady state operation of the ballast circuit 10, the voltage at the common node 56, being a square wave, is approximately one-half of the voltage of the positive terminal 20. The bias voltage that once existed on the capacitor 90 diminishes. The frequency of operation is such that a first network 96 including the capacitor 90 and the inductor 76 and a second network 98 that includes the capacitor 92 and the inductor 78 are equivalently inductive. That is, the frequency of operation is above the resonant frequency of the identical first and second networks 96, 98. This results in the proper phase shift of the gate circuit to allow the current flowing through the inductor 48 to lag the fundamental frequency of the voltage produced at the common node 56. Thus, soft-switching of the inverter 12 is maintained during the steady-state operation.

The output voltage of the inverter 12 is clamped by serially connected clamping diodes 100, 102 of the clamping circuit 16 to limit high voltage generated to start the lamps 28, 30, 32, 34. The clamping circuit 16 further includes the second and third capacitors 52, 54, which are essentially connected in parallel to each other. Each clamping diode 100, 102 is connected across an associated second or third capacitor 52, 54. Prior to the lamps starting, the lamps' circuits are open, since impedance of each lamp 28, 30, 32, 34 is seen as very high impedance. The resonant circuit 14 is composed of the capacitors 36, 38, 40, 42, 50, 52, and 54 and the resonant inductor 48. The resonant circuit 14 is driven near resonance. As the output voltage at the common node 56 increases, the clamping diodes 100, 102 start to clamp, preventing the voltage across the second and third capacitors 52, 54 from changing sign and limiting the output voltage to a value that does not cause overheating of the inverter 12 components. When the clamping diodes 100, 102 are clamping the second and third capacitors 52, 54 the resonant circuit 14 becomes composed of the ballast capacitors 36, 38, 40, 42 and the resonant inductor 48. That is, the resonance is achieved when the clamping diodes 100, 102 are not conducting. When the lamps ignite, the impedance decreases quickly. The voltage at the common node 56 decreases accordingly. The clamping diodes 100, 102 discontinue clamping the second and third capacitors 52, 54 as the ballast 10 enters steady state operation. The resonance is dictated again by the capacitors 36, 38, 40, 42, 50, 52, and 54 and the resonant inductor 48.

A snubber capacitor 104 connected between the common node 56 and the bus rail 22 aids in causing soft switching of the switches 44, 46. Parallel DC blocking capacitors 106, 108 connected between the lamps 28, 30, 32, 34 and the bus rail 22 aid in filtering any DC component from the lamp drive signal. In the manner described above, the inverter 12 provides a high frequency bus 26 at the common node 56 while maintaining the soft switching condition for switches 44, 46. The inverter 12 is able to start a single lamp when the rest of the lamps are lit because there is sufficient voltage at the high frequency bus to allow for ignition.

Figure 2:
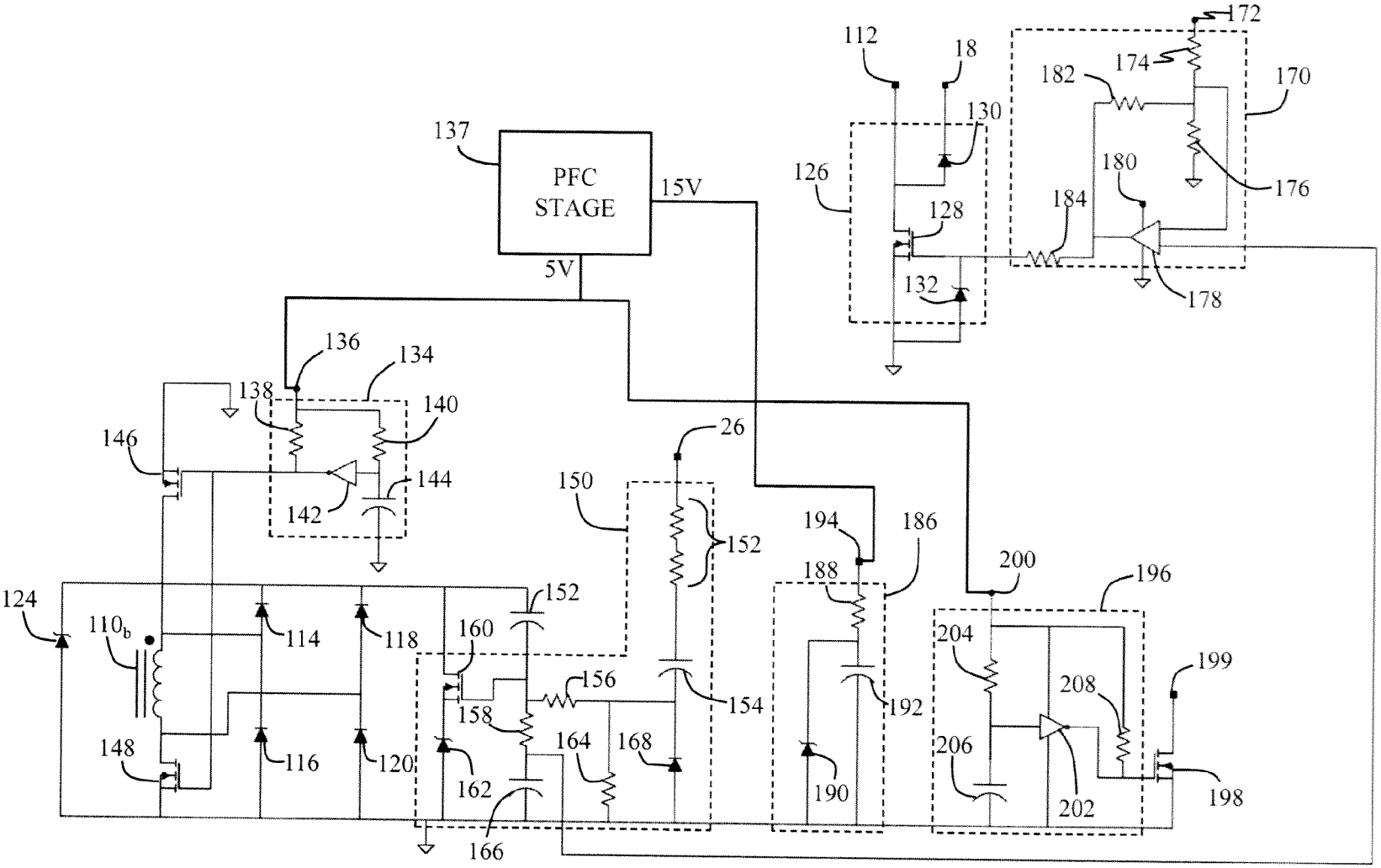
FIG. 2 is a continuing diagram of the ballast shown in FIG. 1.

A filament transformer 110 spans FIGS. 1 and 2. A primary filament transformer winding $\mathbf{110}_a$ is connected between the common node 56 and node 112. With reference now to FIG. 2, node 112 also appears in FIG. 2. Generally, identical reference numerals identify identical points in the circuit that span FIGS. 1 and 2. Additionally, circuit ground for FIG. 2 is the negative bus rail 22, that is, the circuit ground indicators in FIG. 2 are connected to the negative bus rail 22. A filament transformer secondary winding $\mathbf{110}_b$, when active, provides the components of FIG. 2 with a signal. The signal at the common node 56 is an AC signal, and thus an AC signal is seen provided by the filament transformer secondary winding $\mathbf{110}_b$. Diodes 114, 116, 118, and 120 form a full wave bridge rectifier for converting the AC signal provided by the filament transformer secondary winding $\mathbf{110}_b$ into a DC signal. A capacitor 122 provides filtering for signal provided by the secondary winding $\mathbf{110}_b$. A Zener diode 124 provides protection for startup purposes by clamping the voltage across the secondary winding $\mathbf{110}_b$.

During a preheat phase, the filament transformer 110 is activated by a biasing network 126 that includes a switch 128 connected between the filament transformer 110 and the negative bus rail 22, a diode 130 connected between the positive bus rail 18 and the drain of the switch 128, and a Zener diode 132 connected between the gate of the switch 128 and the negative bus rail. When the switch 128 turns on, it activates the filament transformer 110. The filament transformer has additional secondary lamp windings $\mathbf{110}_c$, $\mathbf{110}_d$, $\mathbf{110}_e$, $\mathbf{110}_f$, and $\mathbf{110}_g$ that heat the cathodes of the lamps 28, 30, 32, 34 to a temperature where thermionic emission can occur. This typically takes about 0.5 seconds.

During this time, it is desirable to keep the voltage across the lamps low to prevent destructive glow current from flowing through the lamps 28, 30, 32, 34 until the cathodes are hot. To do this, the inverter frequency is increased above the resonant frequency of the inverter load during the preheat phase. In the illustrated embodiment, additional taps $\mathbf{110}_h$ and $\mathbf{110}_i$ are provided on the filament transformer 110 and added to the gate drive circuits, 68 and 70, respectively. The additional taps $\mathbf{110}_h$, $\mathbf{110}_i$ provide additional drive to the gates of the switches 44, 46 during preheat without changing the turns ratio of the resonant inductor taps 72, 74. This additional drive allows the inverter frequency to increase to such an extent that the glow current on the cathodes of the lamps 28, 30, 32, 34 is 10 mA or less during the preheat phase. The voltage produced on the tap windings $\mathbf{110}_h$ $\mathbf{110}_i$ decreases with the frequency to a voltage that is proportional to the DC bus 18 of the inverter 12. Then, just before ignition, the filament transformer 110 is turned off, and the additional drive is removed from the gates of the switches 44, 46, allowing the lamp voltage to increase effecting a non-destructive ignition of the lamps 28, 30, 32, 34.

In an alternate embodiment, the voltage at the gates of the switches 44, 46 can be increased by changing the turns ratio of the resonant inductor taps 72, 74, but this would cause excessive drive to the gates of the switches 44, 46 during normal operation of the lamps 28, 30, 32, 34, after ignition.

A delay circuit 134 monitors the DC bus 18. The delay circuit 134 is connected at point 136 to a 5 V power supply that comes off of a power factor correction (PFC) stage 137 in FIG. 2. The delay circuit 134 prevents the inverter 12 from oscillating until the DC bus 18 reaches its intended value. The delay circuit 134 includes parallel resistors 138, 140 connected to the point 136 and straddle an inverter 142 with a Schmitt trigger input. A capacitor 144 runs between the resistor 140 and the negative bus rail 22. Transistors 146 and 148 short out the secondary winding of the filament transformer 110*b* during the pre-heat phase. An output of the delay circuit 134 drives the gates of the transistors 146 and 148. Drains of the transistors 146, 148 are connected to opposite ends of the secondary winding of the filament transformer 110b and the sources of the transistors 146, 148 are connected to the negative bus rail 22.

A feedback circuit 150 is connected to the high frequency bus 26. The high frequency bus signal is stepped down by a bias resistor 152. Any remaining DC component of the signal is removed by a capacitor 154. A voltage divider including resistors 156 and 158 reduces the voltage that drives the gate of a feedback transistor 160. The drain of the feedback transistor 160 is connected to the rectified output of the secondary winding of the filament transformer $\mathbf{110}_b$ via diodes 114 and 118. The source of the feedback transistor 160 is connected to the negative bus rail 22 via a reverse facing Zener diode 162. Current of the signal provided to drive the gate of the feedback transistor 160 is divided between the resistor 156 and a resistor 164. The feedback circuit 150 also includes a capacitor 166 located between the resistor 158 and the negative bus rail 22 and a diode 168 in parallel with the resistor 164. The capacitor 166 acts as a low pass filter and feeds the gate drive signal of the feedback transistor 160 to a shunt regulator 170.

The shunt regulator 170 is connected at point 172 to a 5 V power supply off of the PFC stage. The input voltage from point 172 is divided by resistors 174 and 176 and provided to the input of an OP-AMP 178. The other input to the OP-AMP 178 is fed through from the feedback circuit 150. The OP-AMP 178 is powered at node 180 by a 15 V power supply off of the PFC stage, and referenced to the negative bus rail 22. The shunt regulator 170 also includes a resistor 182 in parallel with the OP-AMP 178. The output of the OP-AMP 178 drives the gate of the biasing network switch 128 via a resistor 184. The shunt regulator 170 monitors the arc current and keeps it under desired levels.

A gate drive control network 186 includes a resistor 188 in series with a parallel combination of a Zener diode 190 and a capacitor 192. The gate drive control network is connected between a 15 V power supply off of the PFC stage at node 194 and the negative bus rail 22. The gate drive control network 186 shorts out the gate drive of the transistors 44, 46 for several line cycles during startup. In the illustrated embodiment, the gate drive control network shorts out the gate drive for about 100 ms.

A Schmitt Trigger 196 drives the gate of an inverter control switch 198. The Schmitt Trigger 196 receives an input signal of 5 V from the PFC stage at node 200. Before the DC bus 18 reaches the desired operating voltage, the inverter control switch 198 shorts the lower gate drive circuit 66 to ground, which in turn prevents the inverter 12 from oscillating. The drain of the inverter control switch 198 is connected to point 199 (in the lower gate drive circuit 66) and the source is connected to the negative bus rail 22. Once the bus voltage comes up, the Schmitt Trigger 196 turns the inverter control switch 198, non-conductive, allowing the inverter 12 to oscillate. The Schmitt Trigger includes an amplifier 202, a resistor 204 and a capacitor 206 connected in series between node 200 and the negative bus rail 22, and a resistor 208 connected between the node 200 and the gate of the inverter control switch 198. The inverter control switch 198 is held just long enough to allow the DC bus 18 to reach its operating voltage (about 450 V).

Unlike most voltage fed inverters, the present application maintains a non-capacitive mode without corrective sensing means, minimizes glow current through the lamps 28, 30, 32, 34 prior to ignition, limits component thermals by folding back power under adverse ambient conditions, minimizes lamp striations, and provides an anti-arcing feature. The present application provides a low lamp glow current during preheating, prior to ignition while using a self-oscillating means.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A lamp ballast comprising:

an inverter portion for receiving a direct current input from a DC bus and converting the direct current input into an alternating current output;

a resonant portion that receives the alternating current from the inverter portion and supplies the alternating current to a plurality of lamps; and a filament transformer for providing a preheat current to cathodes of the lamps during a preheat phase, the filament transformer comprising:

a primary winding connected to a common node between the inverter portion and the resonant portion, a first set of secondary windings inductively coupled to the primary winding of the filament transformer that apply the preheat current to the cathodes of the lamps, and a second set of secondary windings that drive transistors of the inverter to a frequency that is higher than a resonant frequency of the resonant portion during the preheat phase.

2. The lamp ballast as set forth in claim 1, wherein the resonant portion supplies the alternating signal to four lamps.

3. The lamp ballast as set forth in claim 2, wherein the lamps are in a parallel configuration with respect to each other.

4. The lamp ballast as set forth in claim 1, further including:

a feedback circuit that monitors a high frequency bus of the resonant portion.

5. The lamp ballast as set forth in claim 4, further including:

a biasing network that includes a transistor that when conductive, activates the filament transformer.

6. The lamp ballast as set forth in claim 5, further including:

a shunt regulator that receives feedback information from the feedback circuit and drives the transistor of the biasing network according to the received feedback.

7. The lamp ballast as set forth in claim 1, further including:

a delay circuit that prevents the inverter from oscillating until the DC bu reaches an operating voltage.

8. The lamp ballast as set forth in claim 7, wherein the operating voltage of the DC bus is substantially 450 V.

9. The lamp ballast as set forth in claim 1, wherein the preheat current is 10 mA or less.

10. A method of igniting at least one lamp comprising:

ramping up a signal of a DC bus to an operating voltage;

providing the DC bus signal to an inverter which operates in a self-oscillating mode to convert the DC bus signal into an AC signal;

providing the AC signal to a resonant portion having a characteristic resonant frequency;

providing a preheat current to cathodes of the at least one lamp with a filament transformer;

boosting a frequency of the AC signal to a frequency greater than the characteristic resonant frequency of the resonant portion, preventing the AC signal from lighting the at least one lamp, wherein the step of boosting the frequency of the AC signal includes adding a first filament transformer secondary winding to a gate drive circuit of a first transistor and adding a second filament transformer secondary winding to a gate drive circuit of a second transistor to increase the drive signals applied to the gates of the first and second transistors;

lowering the frequency of the AC signal to the characteristic resonant frequency, igniting the at least one lamp; and removing the preheat current from the cathodes of the at least one lamp.

11. The method as set forth in claim 10, wherein the step of providing the DC bus signal to the inverter is held off until the DC bus reaches a desired operating voltage by a Schmitt trigger that monitors the DC bus.

12. The method as set forth in claim 11, wherein the desired operating voltage is approximately 450 V.

13. The method as set forth in claim 10, wherein the step of providing a preheat current includes inductively coupling at least one filament transformer secondary winding to a filament transformer primary winding and connecting the at least one filament transformer secondary winding to the cathodes of the at least one lamp.

14. The method as set forth in claim 10, further including:

monitoring a high frequency bus with a feedback network.

15. The method as set forth in claim 14, further including:

removing the filament transformer from the circuit with a bias network based on the activity of the high frequency bus.

16. The method as set forth in claim 10, wherein the step of providing a preheat current includes providing a preheat current of 10 mA or less.

17. An improvement to an instant start lighting ballast, the improvement comprising:

a filament transformer having a primary winding and a first set of secondary windings and a second set of secondary windings, the first set of secondary windings providing preheat currents to cathodes of lamps, and the second set of secondary windings providing additional drive signals to gate drive circuitry of first and second transistors.

18. The improvement as set forth in claim 17, further including:

monitoring circuitry that removes the filament transformer from the ballast when the cathodes are heated.

19. A lamp ballast comprising:

an inverter portion for receiving a direct current input from a DC bus and converting the direct current input into an alternating current output;

a resonant portion that receives the alternating current from the inverter portion and supplies the alternating current to a plurality of lamps;

a filament transformer for providing a preheat current to cathodes of the lamps during a preheat phase;

a feedback circuit that monitors a high frequency bus of the resonant portion;

a biasing network that includes a transistor that when conductive, activates the filament transformer; and a shunt regulator that receives feedback information from the feedback circuit and drives the transistor of the biasing network according to the received feedback.

20. A method of igniting at least one lamp comprising:

ramping up a signal of a DC bus to an operating voltage;

providing the DC bus signal to an inverter which operates in a self-oscillating mode to convert the DC bus signal into an AC signal;

providing the AC signal to a resonant portion having a characteristic resonant frequency;

providing a preheat current to cathodes of the at least one lamp with a filament transformer;

boosting a frequency of the AC signal to a frequency greater than the characteristic resonant frequency of the resonant portion, preventing the AC signal from lighting the at least one lamp;

lowering the frequency of the AC signal to the characteristic resonant frequency, igniting the at least one lamp; and removing the preheat current from the cathodes of the at least one lamp;

wherein the step of providing the DC bus signal to the inverter is held off until the DC bus reaches a desired operating voltage by a Schmitt trigger that monitors the DC bus.

21. The method as set forth in claim 20, wherein the desired operating voltage is approximately 450 V.

* * * * *